US007414604B2

(12) United States Patent
Lin et al.

(10) Patent No.: US 7,414,604 B2
(45) Date of Patent: Aug. 19, 2008

(54) METHOD AND CIRCUIT FOR DRIVING LIQUID CRYSTAL DISPLAY

(75) Inventors: Ching-Wei Lin, Taoyuan (TW); Shih-Chang Chang, Hsinchu (TW); Chun-Hsiang Fang, Dongshan Township (TW)

(73) Assignee: TPO Displays Corp., Chu-Nan (TW)

( * ) Notice: Subject to any disclaimer, the term of this patent is extended or adjusted under 35 U.S.C. 154(b) by 753 days.

(21) Appl. No.: 10/935,860

(22) Filed: Sep. 7, 2004

(65) Prior Publication Data

US 2005/0057476 A1 Mar. 17, 2005

(30) Foreign Application Priority Data

Sep. 16, 2003 (TW) ..... 92125458 A

(51) Int. Cl.
*G09G 3/36* (2006.01)

(52) U.S. Cl. ..... 345/94; 345/55; 345/100

(58) Field of Classification Search ..... 345/94, 345/55, 100
See application file for complete search history.

(56) References Cited

FOREIGN PATENT DOCUMENTS

JP 2001-188217 * 7/2001

* cited by examiner

*Primary Examiner*—Richard Hjerpe
*Assistant Examiner*—Leonid Shapiro
(74) *Attorney, Agent, or Firm*—Liu & Liu

(57) ABSTRACT

A method and circuit for driving LCD are provided. Because the conventional Vcom inversion drive method cannot be applied in a self-aligned process, the power consumption cannot be reduced when the size of the transistor decreases. The method and circuit provided uses two different AC signals to provide different reference voltages for the storage capacitor and the liquid crystal capacitor in a pixel respectively. Therefore, it can be applied to the self-aligned process to reduce the power consumption.

19 Claims, 6 Drawing Sheets

METHOD AND CIRCUIT FOR DRIVING LIQUID CRYSTAL DISPLAY

CROSS-REFERENCE TO RELATED APPLICATION

This application claims the priority benefit of Taiwan application serial no. 92125458, filed on Sep. 16, 2003.

BACKGROUND OF THE INVENTION

1. Field of the Invention

This invention generally relates to a method and a circuit for driving a liquid crystal display, and more particularly to a Vcom inversion drive method and a circuit for driving a liquid crystal display.

2. Description of Related Art

There are several conventional drive methods for driving active liquid crystal displays (LCDs), such as a frame inversion method, a column inversion method, a row inversion method, and a dot inversion method. Anyone of the above methods can be chosen based on image quality, power consumption, and drive complexity. The frame inversion method is the simplest of the above methods, but provides a worst image quality compared to the other methods. Hence, the frame inversion method is rarely adopted. The dot inversion method can provide a best image quality, but requires a higher power and a complex driving circuitry. Hence, the column inversion method and the row inversion method are the most common methods adopted by users when the image quality is not critical.

FIG. 1 is an equivalent circuit of a conventional pixel driving circuit for driving an active LCD. A scan signal $V_S$ 102 is sent to a gate of a transistor 110 to turn the transistor 110 on/off. A data signal $V_D$ 104 is sent to a source of the transistor 110. When the transistor 110 is on, the data signal 104 will go through the transistor 110 to obtain an internal voltage 112 ($V_{lc}$). The internal voltage 112 then is stored in a storage capacitor 130 ($C_{st}$) and a liquid crystal pixel having a capacitance (schematically represented as a liquid crystal capacitor 120 ($C_{lc}$)). The liquid crystal (schematically represented as the liquid crystal capacitor 120) will be driven based on a voltage difference between the internal voltage 112 and the voltage ($V_{com}$) of a DC signal 106. When the transistor 110 is off, the storage capacitor 130 will provide a required voltage level for driving the liquid crystal capacitor 120.

FIG. 2 shows a time sequences for signals illustrated in FIG. 1. Referring to FIG. 2, a DC signal ($V_{com}$) 206 is a reference voltage. When a scan signal ($V_S$) 202 is at a high voltage level, a data signal ($V_D$) 204 enters into a pixel and charges the storage capacitor 130 and the liquid crystal capacitor 120. Hence, an internal voltage 212 can maintain a stable level to provide a voltage difference 210 for the liquid crystal capacitor 120.

The aforementioned inversion driving method causes higher power consumption because the inversion has to be made each time after the data signal enters the pixel, which requires higher voltage amplitude and higher inversion frequency.

FIG. 3 is an equivalent circuit of a conventional pixel driving circuit for driving active LCD by using Vcom inversion (a.k.a. common toggle) drive method. A scan signal 302 is sent to a gate of a transistor 310 to turn the transistor 310 on/off. A data signal 304 is sent to a source of the transistor 310. When the transistor 310 is on, the data signal 304 will go through the transistor 310 to obtain an internal voltage 312. The internal voltage 312 then is stored in a storage capacitor 330 and a liquid crystal capacitor 320. One end of the storage capacitor 330 and one end of the liquid crystal capacitor 320 are coupled to a drain of the transistor 310, the other end (common electrode) of the storage capacitor 330 and the other end of the liquid crystal capacitor 320 are connected to an AC signal 306. The liquid crystal (i.e., having the liquid crystal capacitor 320) will be driven based on a voltage difference between the internal voltage 312 and the AC signal 306. When the transistor 310 is off, the storage capacitor 330 will provide the required voltage level for driving the liquid crystal capacitor 320.

FIG. 4 shows a time sequences for signals illustrated in FIG. 3. Referring to FIG. 4, an AC signal ($V_{com}$) 406 is a reference voltage. When a scan signal ($V_S$) 402 is at a high voltage level, a data signal ($V_D$) 404 enters into a pixel and charges the storage capacitor 330 and the liquid crystal capacitor 320. Hence, an internal voltage 412 can maintain a stable level to provide a voltage difference 410 for the liquid crystal capacitor 320.

The Vcom inversion driving method can reduce the amplitude of the data signal 404. Hence, the required power consumption can reduce. However, because a common electrode of the storage capacitor 330 and that of the liquid crystal capacitor 320 are coupled to the same voltage level, if the storage capacitor 330 is an asymmetric capacitor with polarity, the Vcom inversion driving method cannot be used.

As the manufacturing process advances, the size of the thin film transistor (TFT) is getting smaller and smaller. Hence, the alignment precision is more critical. The traditional optical alignment would not be able to meet the precision requirement. Although the self-aligned manufacturing process can meet the precision requirement and improve the TFT performance, it also results in an asymmetric storage capacitor between the gate electrode and the polysilicon electrode. Hence, the conventional Vcom inversion drive method cannot be used to reduce the power consumption.

SUMMARY OF THE INVENTION

The present invention is directed to a circuit and a method for driving LCD pixels. The circuit includes a transistor coupled to a scan signal and a data signal, and a storage capacitor and a liquid crystal capacitor both coupled to the transistor.

According to another aspect of the present invention, a Vcom inversion driving method can be applied to a self-aligned process allowing further size reduction of a TFT. This method can also reduce the power consumption.

In one aspect of the present invention, a scan signal is adapted for turning on/off the transistor. A data signal is applied to a first end of the storage capacitor and a first end of the liquid crystal capacitor when the transistor is on state, wherein the first end of the storage capacitor is coupled to the first end of the liquid crystal capacitor.

In one aspect of the present invention, the circuit includes first and second AC signals, the first AC signal being coupled to the liquid crystal capacitor and the second AC signal being coupled to the storage capacitor. In one embodiment, the first AC signal includes a DC offset voltage more than a DC component of the first AC signal. In some embodiments, the DC offset voltage is at least higher than the amount of a threshold voltage of an equivalent transistor of the storage capacitor plus a maximum voltage difference for driving the pixel. In another embodiment of the present invention, the first and second AC signals are synchronized and have same amplitudes.

In one aspect of the present invention provides, a circuit for driving a liquid crystal display is provided. The circuit comprises a transistor, a liquid crystal capacitor and a storage capacitor. The transistor has a gate coupled to a scan signal and a source coupled to a data signal. The liquid crystal capacitor has a first end and a second end. The first end of the liquid crystal capacitor is coupled to a drain of the transistor, and the second end of the liquid crystal capacitor is coupled to a first AC signal. The liquid crystal capacitor is filled with a liquid crystal, wherein a transmission ratio is changed based on a voltage difference between the first and second ends of the liquid crystal capacitor. The storage capacitor has a first end and a second end. The first end of the storage capacitor is coupled to the drain of the transistor and the second end of the storage capacitor is coupled to a second AC signal.

In one embodiment of the present invention, the transistor is a thin film transistor; the storage capacitor is an asymmetric capacitor with polarity formed by a self-aligned process.

In one aspect of the present invention, a driving method for driving an LCD of the present invention uses two different AC signals to provide different reference voltages for a storage capacitor and a liquid crystal capacitor in a pixel respectively. In another aspect of the present invention, to maintain a voltage difference between the storage capacitor and the liquid crystal capacitor, the two different AC signals have to be synchronized and have same amplitude. In yet another aspect of the invention, the AC signal for the storage signal has an additional DC offset voltage more than that for the liquid crystal signal to maintain the maximum capacitance for the storage capacitor. Therefore, the present invention can use the self-aligned process to reduce the power consumption.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENTS

Figure 1:
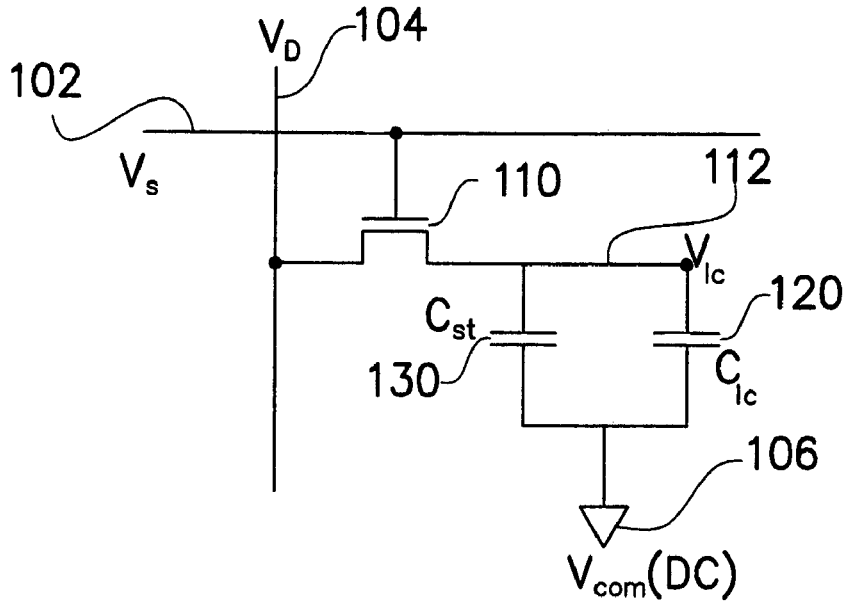
FIG. 1 (PRIOR ART)
FIG. 1 is an equivalent circuit of a conventional pixel driving circuit for an active LCD.
Figure 2:
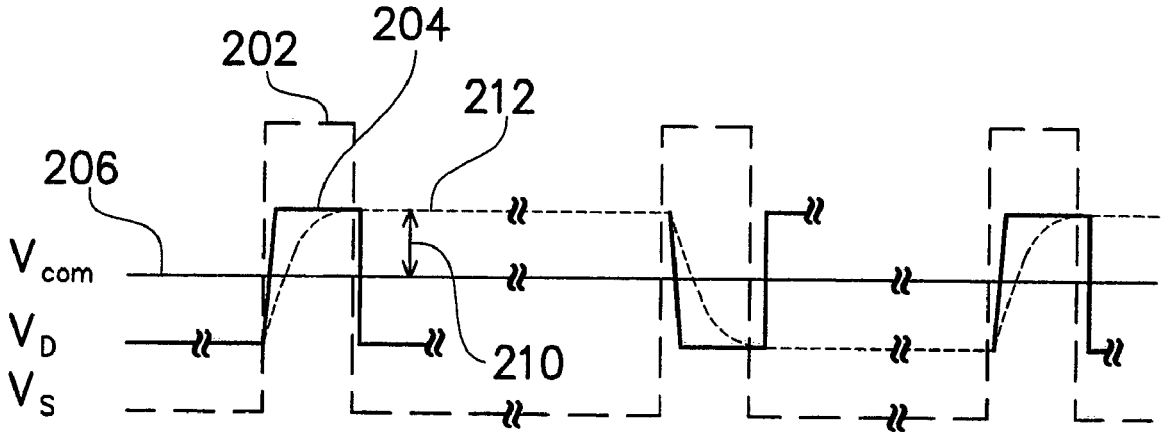
FIG. 2 (PRIOR ART)
FIG. 2 shows a time sequences for signals illustrated in FIG. 1.
Figure 3:
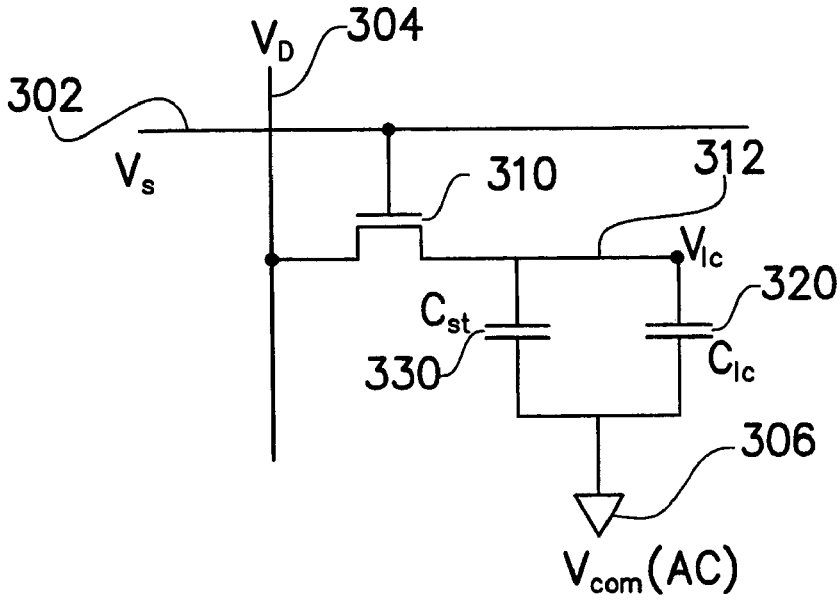
FIG. 3 (PRIOR ART)
FIG. 3 is an equivalent circuit of a conventional pixel driving circuit for an active LCD using the Vcom inversion driving method.
Figure 4:
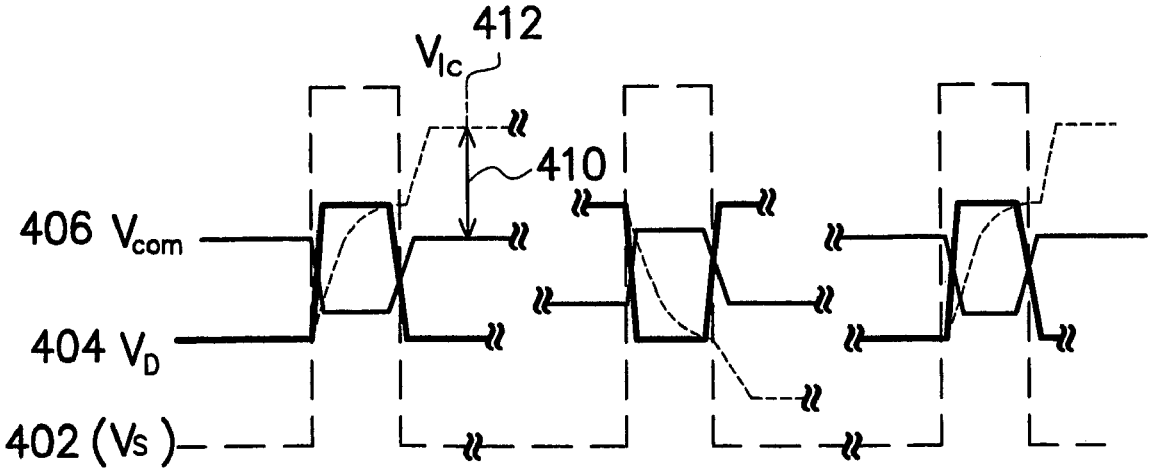
FIG. 4 (PRIOR ART)
FIG. 4 shows a time sequences for signals illustrated in FIG. 3.
Figure 5A:
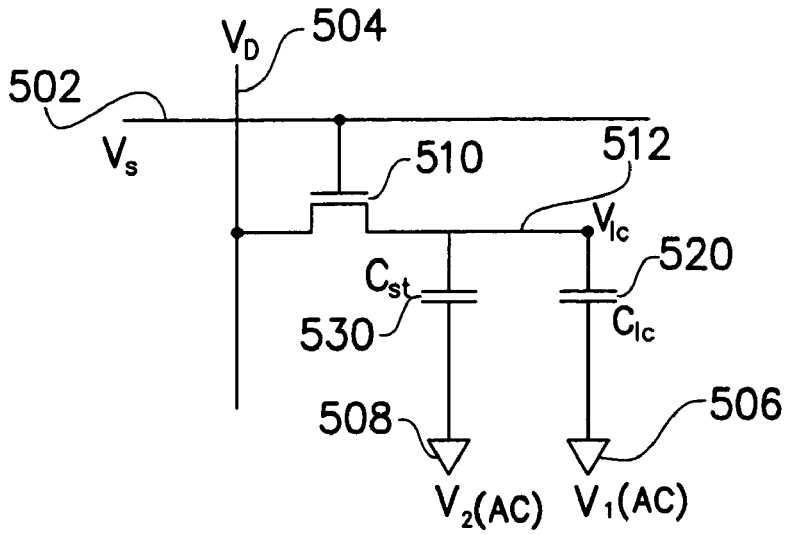
FIG. 5A is an equivalent pixel driving circuit for an active LCD in accordance with one embodiment of the present invention.

FIG. 5A is an equivalent pixel driving circuit for an active LCD in accordance with one embodiment of the present invention. A scan signal ($V_S$) 502 is sent to a gate of the transistor 510 to turn the transistor 510 on/off. A data signal ($V_D$) 504 is sent to a source of the transistor 510. When the transistor 510 is on, the data signal 504 will go through the transistor 510 to obtain an internal voltage ($V_{lc}$) 512. The internal voltage 512 then is stored in a storage capacitor ($C_{st}$) 530 and a liquid crystal capacitor ($C_{lc}$) 520. One end of the storage capacitor 530 and one end of the liquid crystal capacitor 520 are coupled to a drain of the transistor 510. The other end of the storage capacitor 530 is coupled to a second AC signal ($V_2$) 508. The other end of the liquid crystal capacitor 520 is coupled to a first AC signal ($V_1$) 506.

Figure 5B:
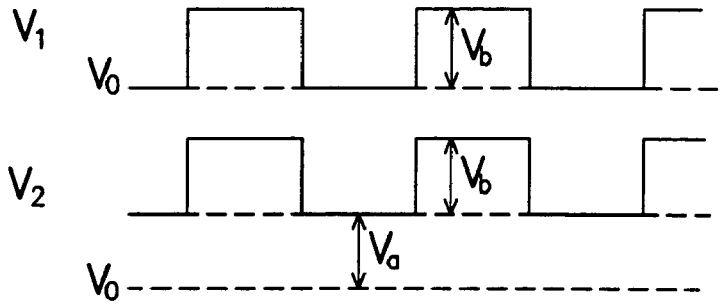
FIG. 5B is a time sequences for the first and second AC signals shown in FIG. 5A.

FIG. 5B shows time sequences of the first and the second signals shown in FIG. 5A. In this embodiment, the second AC signal $V_2$ has a DC offset voltage ($V_a$) more than the DC component of the first AC signal $V_1$. The DC offset voltage ($V_a$) has to be higher than the amount of the threshold voltage of an equivalent transistor of the storage capacitor 530 plus the maximum voltage difference for driving the liquid crystal in order to maintain a large capacitance of storage capacitor. The liquid crystal (i.e., having liquid crystal capacitor 520) will be driven based on the voltage difference between the internal voltage 512 and the first AC signal 506. When the transistor 510 is off, the storage capacitor 530 will provide the required voltage level for driving the liquid crystal capacitor 520.

Figure 6:
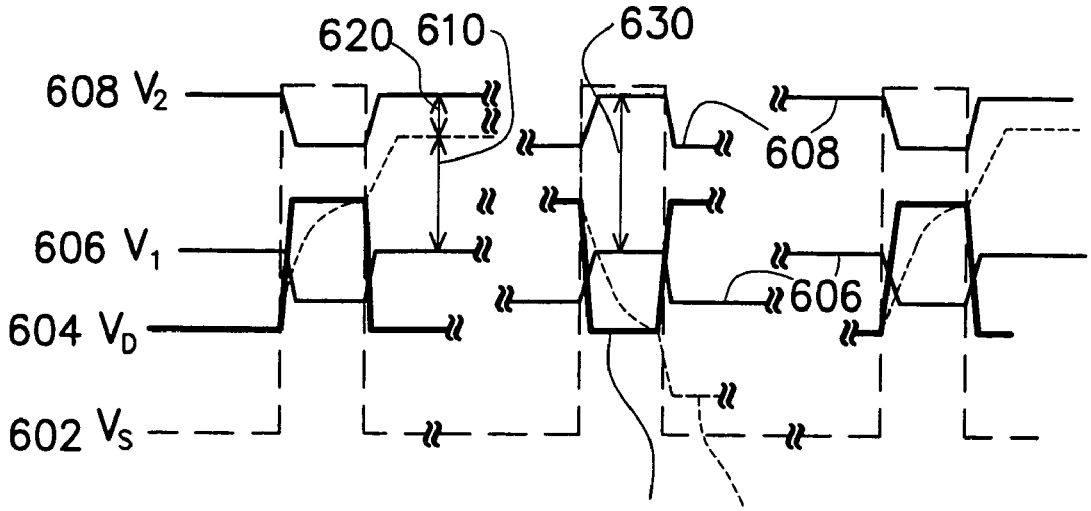
FIG. 6 shows a time sequences for signals illustrated in FIG. 5A.
Figure 7:
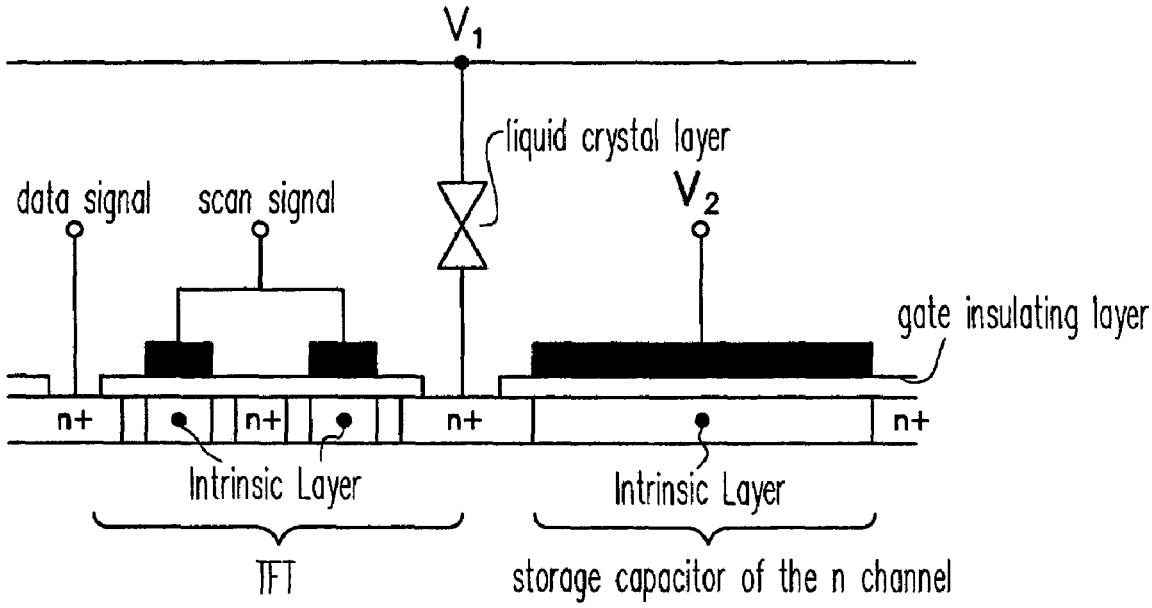
FIG. 7 shows the pixel driving circuit layers based on the equivalent pixel driving circuit shown in FIG. 5.

FIG. 6 shows time sequences for signals illustrated in FIG. 5. FIG. 7 shows the pixel drive circuit layers based on the equivalent pixel drive circuit shown in FIG. 5. Referring to FIG. 6, a voltage difference 610 required to drive the liquid crystal is provided by a voltage difference between an internal voltage 612 and a first AC signal 606. When a scan signal ($V_S$) 602 is at a high voltage level, a data signal ($V_D$) 604 enters into the pixel and charges the storage capacitor 530 and the liquid crystal capacitor 520. Hence, the internal voltage 612 can maintain a stable level to provide the voltage difference 610 for the liquid crystal capacitor 520. Further, a second AC signal ($V_2$) 608 has a DC offset voltage 630 higher than the first AC signal ($V_1$) 606. In some embodiments, the DC offset voltage 630 is at least higher than the amount of the threshold voltage of an equivalent transistor of the storage capacitor 530 plus the maximum voltage difference 610 for driving the liquid crystal. Hence, the second AC signal 608 has a voltage higher than the internal voltage 612, the difference being a storage capacitor voltage difference 620, so that the storage capacitor 530 can maintain the same polarity and maintain a maximum capacitance. The first AC signal 606 and the second AC signal 608 are synchronized with each other and have the same amplitude so that the voltage difference across the liquid crystal capacitor can be kept stable. Hence, the present invention can be applied to a self-aligned process.

Figure 8:
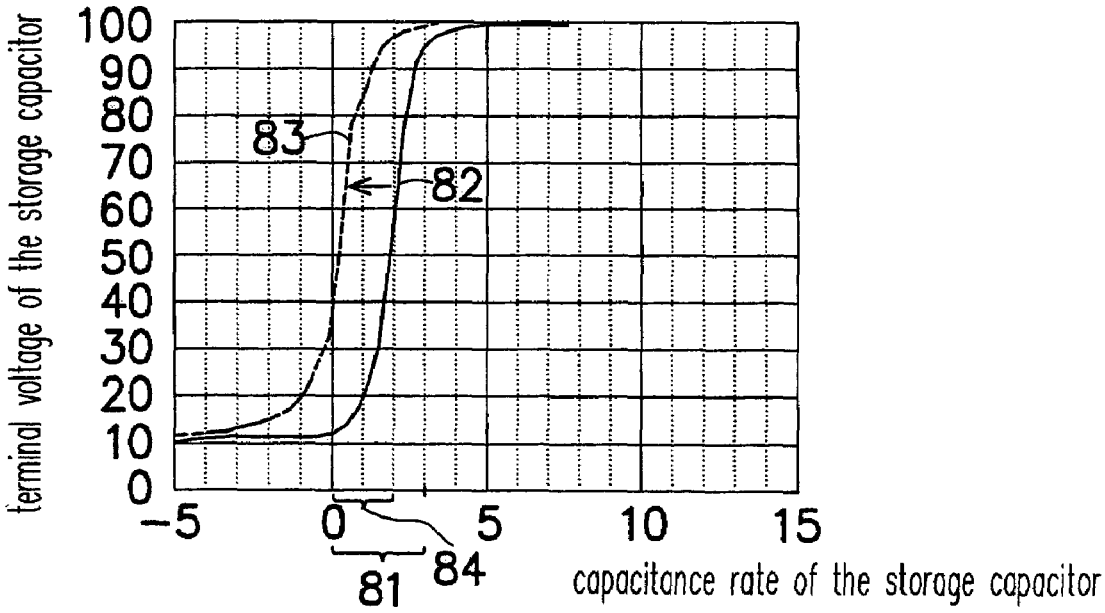
FIG. 8 shows the relationship between the terminal voltage of the storage capacitor and the capacitance ratio.

In another embodiment, the threshold voltage of the equivalent transistor of the storage capacitor can be adjusted by adjusting the doping amount in the storage capacitor to reduce the DC offset voltage. FIG. 8 shows the relationship between the terminal voltage of the storage capacitor and the capacitance ratio. It shows that the relationship between the terminal voltage of the storage capacitor and the capacitance ratio is nonlinear. Taking the curve 82 as an example, the terminal voltage of the storage capacitor must be higher than the threshold voltage 81 to storage charge. To reduce the required voltage for the driving circuit (and thus reduce the power consumption), the threshold voltage of the equivalent transistor of the storage capacitor can be adjusted by adjusting the doping amount in the storage capacitor. The curve 82 represents a storage capacitor characteristic curve with a particular doping amount. After changing the doping amount, the curve 82 shifts toward the left direction to be a new curve 83. Further, the threshold voltage is reduced from 81 to a new threshold voltage 84. In addition, the threshold voltage of the equivalent transistor of the storage capacitor can be set negative based on the design requirement. The threshold voltage of the equivalent transistor of the storage capacitor can be different from a threshold voltage of the transistor 510.

The liquid crystal (i.e., the liquid crystal capacitor 520) will be driven based on the voltage difference between the internal voltage 512 and the first AC signal 506. When the transistor 510 is off, the storage capacitor 530 will provide the required voltage level for driving the liquid crystal capacitor 520.

Figure 9:
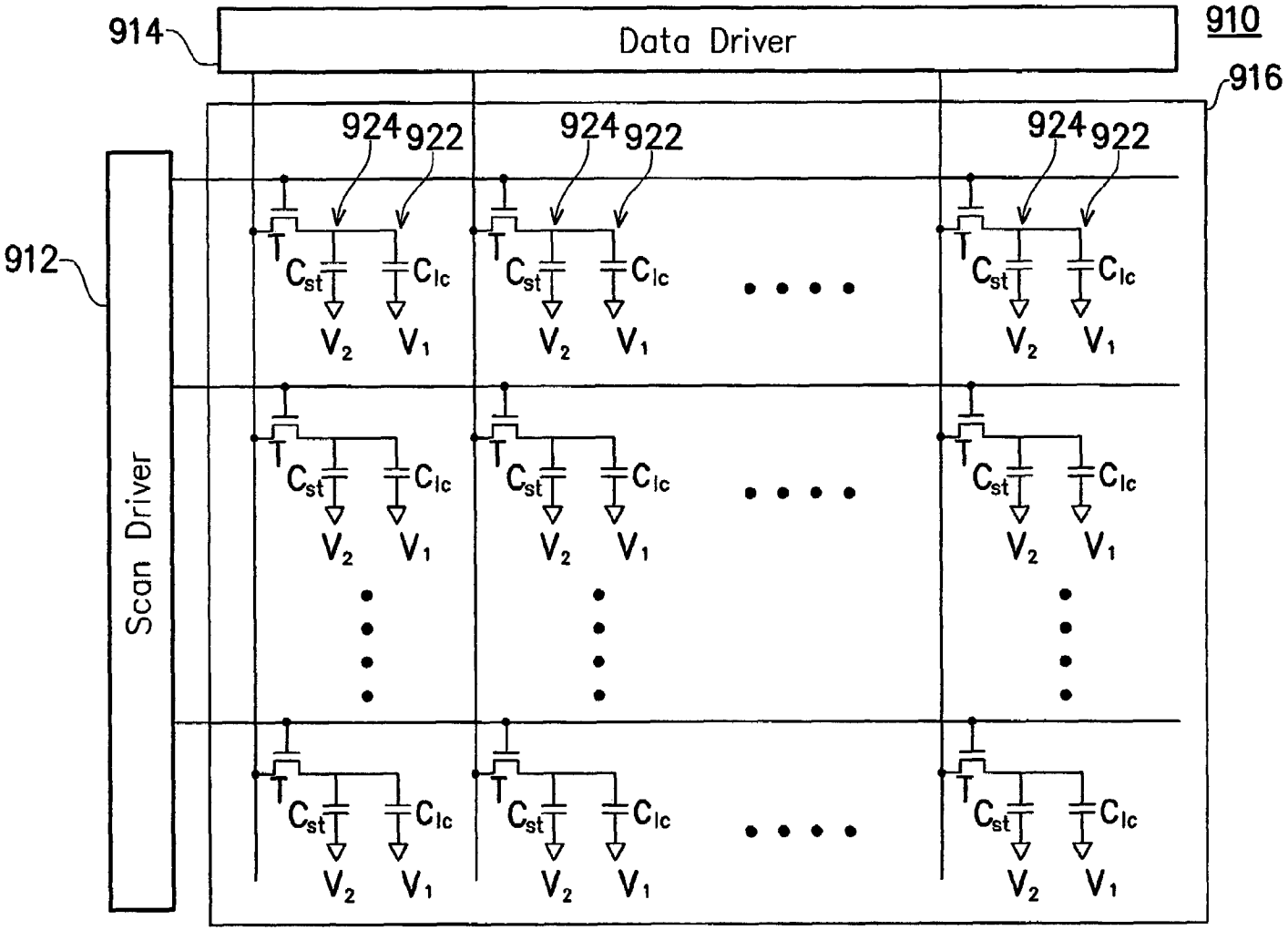
FIG. 9 is a schematic diagram of an LCD device incorporated with the pixel driving circuit shown in FIG. 5A.

FIG. 9 is a schematic diagram of an LCD device 910 incorporated with the pixel driving circuit shown in FIG. 5A. The LCD device 910 includes a scan driver 912, a data driver 914 and an LCD panel 916. The LCD panel 916 includes pixels 922 and corresponding pixel driving circuits 924. The scan driver 912 provides scan signals for the LCD panel 916. The data driver 914 provides data signals for the LCD panel 916. The pixel driving circuits 924, for driving the corresponding pixel 922, includes a transistor T, coupled to the scan signal from the scan driver 912 and a data signal from the data driver 914, a liquid crystal capacitor ($C_{lc}$) and a storage capacitor ($C_{st}$), coupled to the transistor T. A first AC signal $V_1$ is coupled to the liquid crystal capacitor ($C_{lc}$), and a second AC signal $V_2$ is coupled to the storage capacitor ($C_{st}$).

Figure 10:
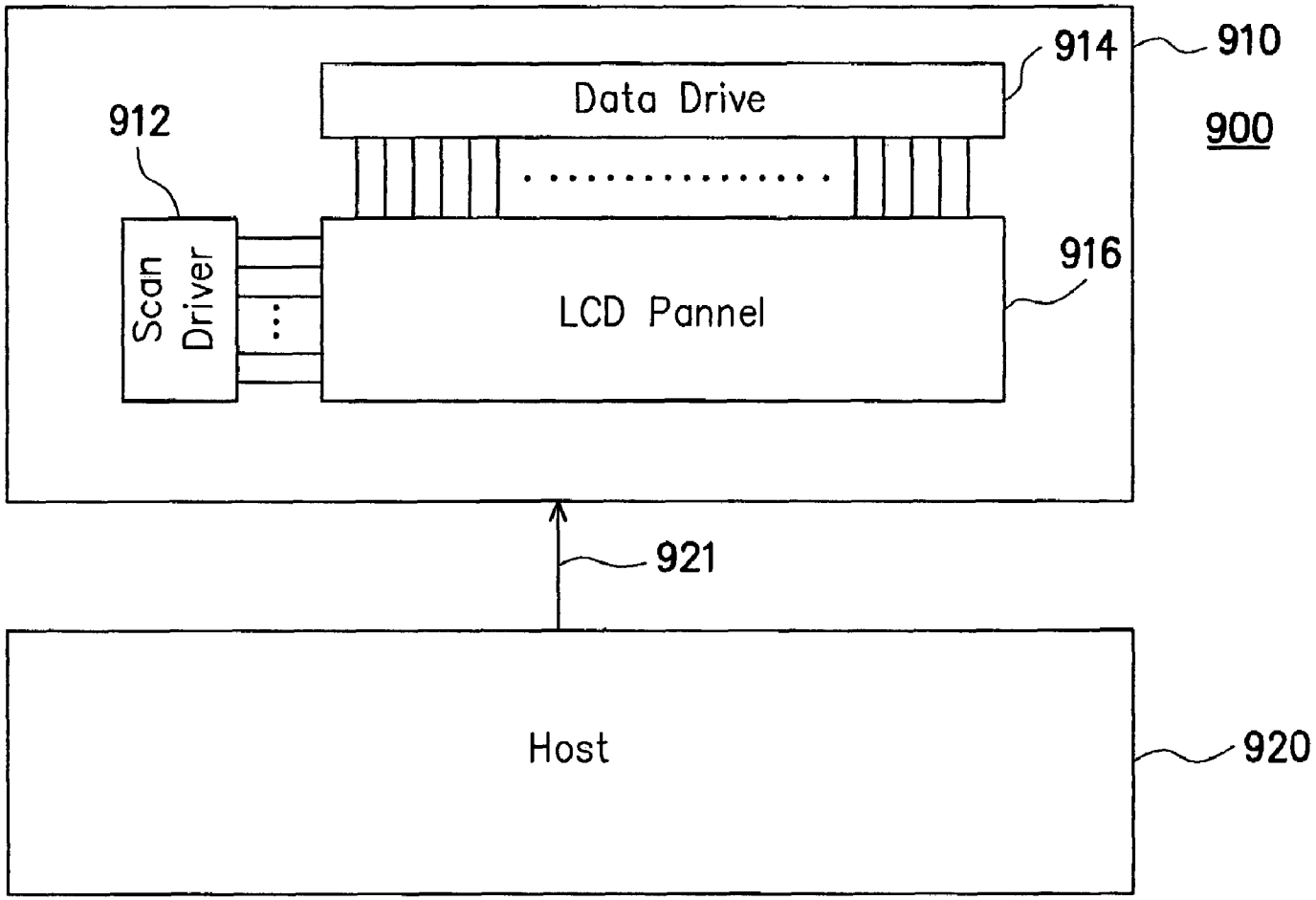
FIG. 10 is a schematic diagram of an electronic device incorporating an LCD device incorporated with the pixel driving circuit shown in FIG. 5A.

FIG. 10 is a schematic diagram of an electronic device 900 with the LCD device 910, as shown in FIG. 9, incorporated with the pixel driving circuit shown in FIG. 5A. The LCD device 910 includes a scan driver 912, a data driver 914 and an LCD panel 916. The LCD panel 916 includes plurality of pixels and corresponding pixel driving circuits shown in FIG. 5A. The scan driver 912 provides scan signals for the LCD panel 916. The data driver 914 provides data signals for the LCD panel 916. The pixel driving circuits therein are used for driving the corresponding pixels, each of which includes a transistor, coupled to the corresponding scan signal from the scan driver and a data signal from the data driver 914, a liquid crystal capacitor ($C_{lc}$) and a storage capacitor ($C_{st}$), coupled to the transistor. A first AC signal $V_1$ is coupled to the liquid crystal capacitor ($C_{lc}$), and a second AC signal $V_2$ is coupled to the storage capacitor ($C_{st}$). The electronic device 900 further includes a host 920 for providing source signals 921 for displaying in the LCD device 910.

The driving method for driving LCD of the present invention uses two different AC signals to provide different reference voltages for the storage capacitor and the liquid crystal capacitor in a pixel respectively. To maintain the voltage difference between the storage capacitor and the liquid crystal capacitor, the two different AC signals have to be synchronized and have same amplitude. In addition, the AC signal for the storage signal has an additional DC offset voltage more than that for the liquid crystal signal to maintain the maximum capacitance for the storage capacitor. Therefore, the present invention can use the self-aligned process to reduce the power consumption.

The above description provides a full and complete description of the embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

What is claimed is:

1. A method for driving liquid crystal display pixels, each of said pixels including a transistor, a storage capacitor, and a liquid crystal capacitor, said method comprising the following steps:

applying a scan signal to said transistor;

applying a data signal to said storage capacitor and said liquid crystal capacitor when said transistor is on; and applying a first AC signal and a second AC signal to said liquid crystal capacitor and to said storage capacitor respectively, wherein said first and said second AC signals are applied synchronously with same amplitudes.

2. The method of claim 1, wherein said second AC signal includes a DC offset voltage higher than a DC voltage component of said first AC signal.

3. The method of claim 2, wherein said DC offset voltage is at least higher than the amount of a threshold voltage of an equivalent transistor of said storage capacitor plus a maximum voltage difference for driving said pixel.

4. The method of claim 3, wherein providing said DC offset voltage is adjusted by adjusting a doping amount in said storage capacitor to reduce said DC offset voltage.

5. The method of claim 3, wherein said threshold voltage of said equivalent transistor of said storage capacitor is different from a threshold voltage of said transistor.

6. A circuit for driving a liquid crystal display pixel, comprising:

a transistor, coupled to a scan signal and a data signal;

a liquid crystal capacitor, coupled to said transistor;

a first AC signal, coupled to said liquid crystal capacitor;

a storage capacitor, coupled to said transistor; and a second AC signal, coupled to said storage capacitor, wherein said first and said second AC signals are applied synchronously and have same amplitudes.

7. The circuit of claim 6, wherein said transistor is a thin film transistor having a gate coupled to a scan signal, said transistor having a source coupled to a data signal.

8. The circuit of claim 7, wherein said storage capacitor is an asymmetric capacitor with polarity formed by a self-aligned process.

9. The circuit of claim 6, wherein said second AC signal includes a DC offset voltage more than a DC component of said first AC signal.

10. The circuit of claim 9, wherein said DC offset voltage is at least higher than a threshold voltage of an equivalent transistor of the storage capacitor plus a maximum voltage difference for driving said pixel.

11. An LCD device, comprising:

a plurality of liquid crystal display pixels; and a circuit as in claim 6, for driving each liquid crystal display pixel.

12. An electronic device comprising an LCD device claimed in claim 11.

13. A circuit for driving a liquid crystal display pixel, comprising:

a transistor, coupled to a scan signal and a data signal;

a liquid crystal capacitor, coupled to said transistor;

a first AC signal, coupled to said liquid crystal capacitor;

a storage capacitor, coupled to said transistor, wherein said storage capacitor is an asymmetric capacitor with polarity formed by a self-aligned process; and a second AC signal, coupled to said storage capacitor.

14. The circuit of claim 13, wherein said transistor is a thin film transistor having a gate coupled to a scan signal, said transistor having a source coupled to a data signal.

15. The circuit of claim 13, wherein said second AC signal includes a DC offset voltage more than a DC component of said first AC signal.

16. The circuit of claim 15, wherein said DC offset voltage is at least higher than a threshold voltage of an equivalent transistor of the storage capacitor plus a maximum voltage difference for driving said pixel.

17. The circuit of claim 13, wherein said first and said second AC signals are applied synchronously and have same amplitudes.

18. An LCD device, comprising;

a plurality of liquid crystal display pixels; and a circuit as in claim 13, for driving each liquid crystal display pixel.

19. An electronic device comprising an LCD device claimed in claim 18.

* * * * *